US005392908A

United States Patent [19]

Black, Jr.

[11] Patent Number: 5,392,908

[45] Date of Patent: Feb. 28, 1995

[54] PACKAGE FOR SHIPPING, STORING, AND HANDLING TRUSS PLATES AND METHOD FOR FORMING SAME

[75] Inventor: William H. Black, Jr., Edenton, N.C.

[73] Assignee: Tee-Lok Corporation, Edenton, N.C.

[21] Appl. No.: 232,899

[22] Filed: Apr. 25, 1994

[51] Int. Cl.[6] ..... B65D 85/46

[52] U.S. Cl. ..... 206/321; 206/451

[58] Field of Search ..... 206/321, 227, 451, 338, 206/342; 53/443, 447

[56] References Cited

U.S. PATENT DOCUMENTS

| | | | |
|---|---|---|---|
| 2,271,632 | 2/1942 | Diehl | 206/321 X |
| 2,996,721 | 8/1961 | Black | 1/149 |
| 3,100,301 | 8/1963 | Black | 1/60 |
| 3,377,905 | 4/1968 | McAlpine | 85/13 |
| 3,416,283 | 12/1968 | Sanford | 52/693 |
| 3,473,362 | 10/1969 | Black et al. | 72/326 |
| 3,498,170 | 3/1970 | Sanford | 85/13 |
| 3,880,286 | 4/1975 | Wegener | 206/451 X |
| 4,965,740 | 10/1990 | Schofield et al. | 364/512 |
| 5,218,813 | 6/1993 | Seidel | 53/447 X |
| 5,265,722 | 11/1993 | Schmidmeister | 206/321 |

OTHER PUBLICATIONS

Tee-Lok, Inc., Truss Plate Package Photos (Photos 1-5).

*Primary Examiner*—Jacob K. Ackun

*Attorney, Agent, or Firm*—Bell Seltzer Park & Gibson

[57] ABSTRACT

A bundle of truss plates useful in shipping, storage, and handling is disclosed. Also disclosed are a self-supporting stack of truss plate bundles and a shipping package in which such a stack is positioned on an underlying pallet.

31 Claims, 6 Drawing Sheets

PACKAGE FOR SHIPPING, STORING, AND HANDLING TRUSS PLATES AND METHOD FOR FORMING SAME

FIELD OF THE INVENTION

The present invention relates generally to packaging, and more specifically relates to the packaging of truss plates used in construction.

BACKGROUND OF THE INVENTION

Truss plates are generally employed to join planks of lumber that form floor and roof trusses used in residential housing. Truss plates typically comprise a backing plate and an array of sharp spike-like impaling members that extend outwardly from the backing plate. Adjacent planks of a truss with coplanar surfaces can be permanently joined by pounding or pressing the backing member of a truss plate so that its impaling members penetrate the planks.

Typically, the joints of a truss are not formed one at a time. Instead, all of the planks comprising the truss are arranged in the desired configuration on a large table or series of tables configured for truss construction. Truss plates are then placed at points of contact between two or more adjacent planks and are pounded with a single stroke of a mallet to set the planks temporarily. A mechanical roller or press is then applied to all of the planks comprising the truss, thereby pressing the impaling members of each truss plate completely into the adjacent planks to provide a secure and permanent joint therebetween. The truss is then inverted and the process is repeated on the opposing surfaces of the planks.

A particular house or building will usually require several trusses of identical configuration. To increase manufacturing efficiency, identical trusses are usually built in succession. As these trusses often have as many as 20 or 30 joints and require two truss plates per joint, line workers constructing the trusses should have many truss plates within easy reach to allow them to quickly position and set the plates prior to application of the roller or press. A convenient and accessible workspace on which to store the plates prior to use is the edge portion of the truss table itself. However, truss table rollers and presses are most commonly sized to extend the full width of the table in order to accommodate trusses of varying widths. As a result, the space on the truss table edge portion available to line workers for storage of truss plates is restricted in height to that residing below the elevation of the roller, which is typically about four inches above the table surface.

Because of this height restriction, line workers will often form the truss plates into cooperating pairs, or couplets, in which the impaling members of each of a pair of truss plates face and interpose with one another and the backing members of the pair are disposed in parallel relationship. The truss plates of a couplet are not permanently interconnected in any manner, but the positional interrelationship of the impaling members restricts lateral movement of the truss plates relative to one another, so the plates comprising a couplet tend to stay together. Couplets of truss plates can be neatly stacked along the edge portion of the truss table near the location of the joint they are to secure. Stacking the plates in couplets conserves space on the truss table edge portion, thus enabling the storage of more truss plates per unit area. Also, a couplet stack provides a predictable truss plate orientation for the line worker, who must handle these sharp items quickly without injury.

Truss plates are typically packaged in boxes or cartons in no order whatsoever; they are simply strewn haphazardly in their container. If the container is emptied or if it is somehow removed or destroyed, the truss plates spill and spread and can be quite hazardous until they are retrieved and restored. As a result, the truss plates are generally stored on-site in their packaging cartons until use.

Not surprisingly, removing sharp truss plates that have been packaged randomly in a box or carton, forming them into couplets, and stacking the couplets on a truss table is a tedious process. However, for improved efficiency and safety, many truss construction firms will form and stack couplets prior to truss construction despite the time and trouble doing so entails. The prior art is completely silent on packaging methods that address truss plate packaging.

Thus it is a first object of the present invention to provide a truss plate package which enables simple transfer of the truss plates from the package to a stack of couplets on a truss table.

Another object of the present invention is to provide a truss plate package from which truss plates will not spill or spread following removal of the enclosure.

An additional object of the present invention is to provide a method of packaging truss plates that effects simple transfer of the truss plates contained therein to a stack of couplets.

SUMMARY OF THE INVENTION

These objects and others are satisfied by the present invention, which is directed to an improved truss plate packaging configuration. The package is based on the use of the truss plate bundles. These bundles comprise a plurality of truss plates, wherein each truss plate has a generally planar backing member and a plurality of impaling members extending outwardly from one side thereof. The truss plates are arranged in a plurality of cooperating pairs, wherein the backing members of each pair are disposed in a parallel overlying relationship, with the impaling members of each truss plate extending toward the backing member of the other truss plate. The bundles further comprise connecting means cooperating with the plurality of pairs of truss plates for effecting unitization thereof so that the backing member of one of the truss plates of each pair is in contacting parallel relationship with a backing member of another of said plurality of cooperating pairs. The bundles can be simply handled, and couplets can be formed quickly on a truss table prior to the incorporation of truss plates into a truss.

The bundles can be formed into a stack, wherein a plurality of the truss plate bundles is arranged in a plurality of layers, with the bundles of each respective layer contacting the bundles of an adjacent layer, and wherein all of the truss plate backing members extend in an upright plane. Preferably, the bundles of each layer are offset from the bundles of an adjacent layer. A stack so formed is sufficiently stable to be self-supporting. A self-supporting stack facilitates shipping and storage of the truss plates, as they do not spill when their enclosing carton is removed. The stack can be advantageously formed into a shipping package on an underlying shipping pallet connected to an enclosing carton.

DETAILED DESCRIPTION OF THE INVENTION

Figure 1:
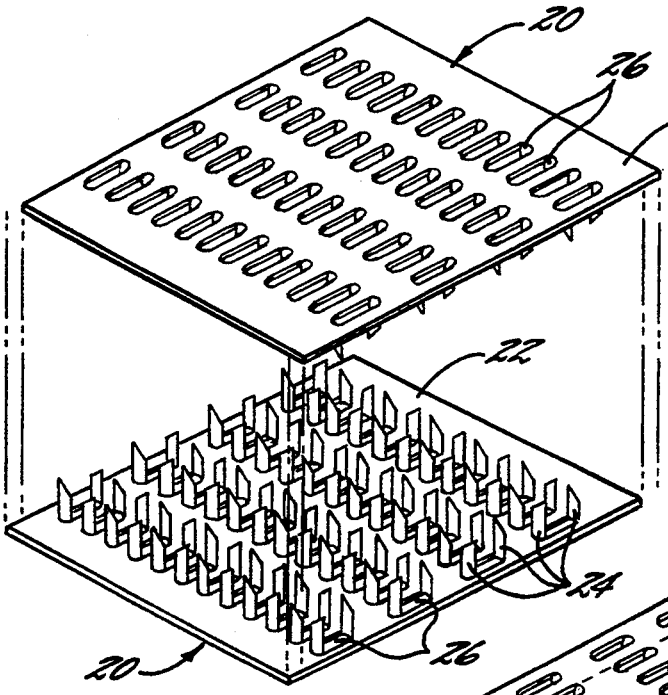
FIG. 1 is an exploded perspective view showing a pair of truss plates.
Figure 2:
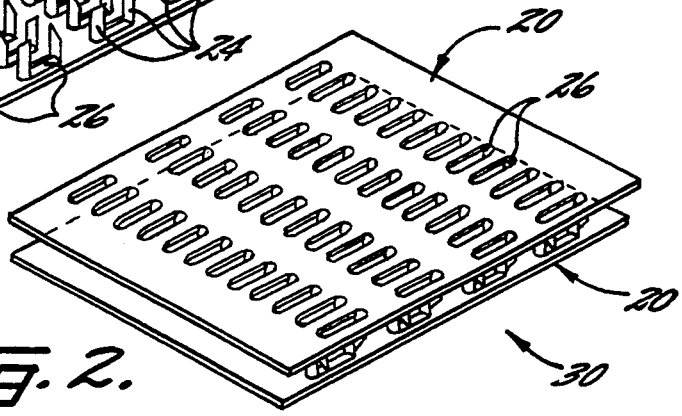
FIG. 2 is a perspective view of a truss plate couplet formed of cooperating truss plates.

The present invention will be described more particularly more hereinafter with reference to the accompanying drawings. The invention is not intended to be limited to the illustrated embodiment; rather, this embodiment is intended to fully and completely disclose the invention to those skilled in this art.

Referring now to the drawings, a pair of substantially identical truss plates 20 are shown in FIGS. 1 through 4. Each of these truss plates 20 comprises a generally planar backing member 22 and a plurality of impaling members 24. The impaling members 24 extend outwardly from one side of the backing member 22. In the embodiment illustrated in FIGS. 1 through 4, individual impaling members are arranged in pairs formed by striking out a portion of the backing member 22 with a punch of oblong cross-section; the impaling members 24 formed thereby extend from the backing member 22 at the longitudinal edges of an elongated aperture 26 formed by the punch. Struck-out impaling members 24 are preferred, as they have a slightly arcuate cross-section (FIGS. 4 and 5) as a consequence of the striking process that renders the impaling members 24 more resistant to bending during penetration into a plank. Those skilled in this art will appreciate that the impaling members of the truss plates can be formed by other techniques, such as roll-forming, and still be suitable for use with this invention.

The illustrated rectangular shape of the backing member 22 is preferred; common rectangular backing member sizes include backing members that measure 3 inches in width by 4 inches in length and those that measure 5 inches in width by 6, 7, or 8 inches in length, but plates may be as large as 20 inches in length and width or even larger. As used herein, the term "length" referring to a backing member refers to the larger of the two dimensions defining the rectangular plate comprising the backing member. Preferably, the backing member 22 has a length to width ratio of between 1 to 1 and 4 to 1. It should be understood that the backing member 22 can take other forms, such as those in which the corners of a rectangular backing member are rounded or beveled, are also suitable for use with the present invention. The backing member 22 is generally formed of steel approximately 0.036 inches in thickness, although this thickness can vary depending upon the performance requirements for the truss to be constructed.

Figure 4:
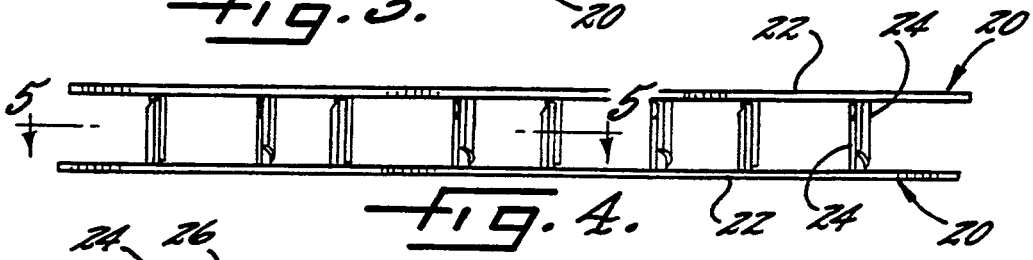
FIG. 4 is a side view of a truss plate couplet.
Figure 5:
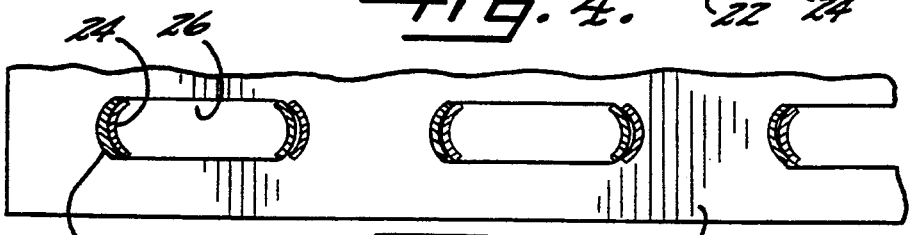
FIG. 5 is a cross-sectional view taken along line 5—5 of FIG. 4.
Figure 6:
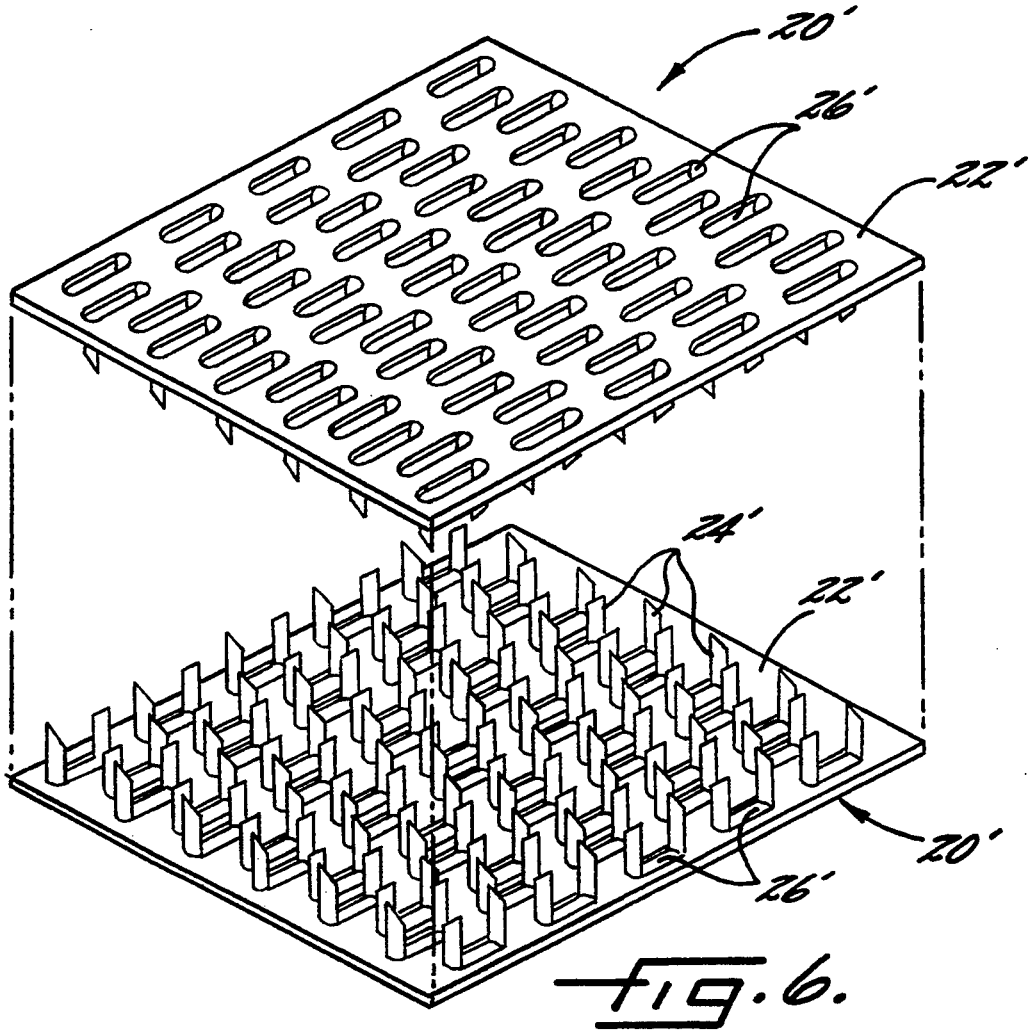
FIG. 6 is an exploded perspective view of a pair of truss plates having teeth arranged in a staggered array.
Figure 7:
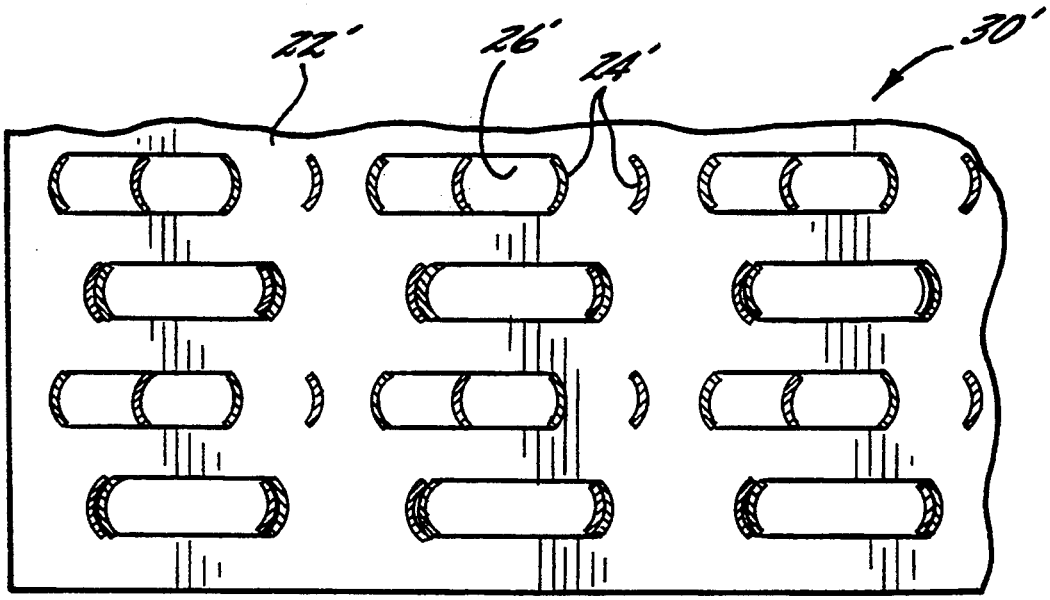
FIG. 7 is a sectional top view of a truss plate couplet having staggered teeth.

In the embodiment illustrated in FIGS. 1 through 5, the impaling members 24 and the apertures 26 are positioned on the backing member 22 in a plurality of parallel rows; however, the impaling members 24 and apertures 26 can be positioned on the backing member 22 in other arrangements, one of which is illustrated in FIGS. 6 and 7. Each of a pair of truss plates 20' comprises a planar backing member 22' and a plurality of impaling members 24'. In contrast to the truss plates 20 of FIGS. 1 through 5, the impaling members 24' and apertures 26' are arranged so that adjacent impaling members 24 and apertures 26 are alternately staggered relative to one another. Unless otherwise stated, those skilled in this art will appreciate that the ensuing discussion is equally applicable to the "in-line" impaling members 24 of the truss plates 20, the staggered impaling members 24' of the truss plates 20', and other configurations.

Illustratively the impaling members 24 are approximately 0.125 inches in width and are spaced apart approximately 0.125 inches from adjacent impaling members in the same row on the backing member 22. The impaling members 24 in adjacent rows are spaced apart approximately 0.5 inches. Typically, the impaling members 24 extend from the backing member 22 between about 0.2 and 0.5 inches. If the impaling members 24 are formed by striking out the backing member 22, the impaling members 24 will be approximately equal in thickness to the backing member 22. Those skilled in this art will appreciate that, although the aforementioned dimensions are preferred, truss plates suitable for use with the present invention can take a wide variety of dimensions.

Figure 3:
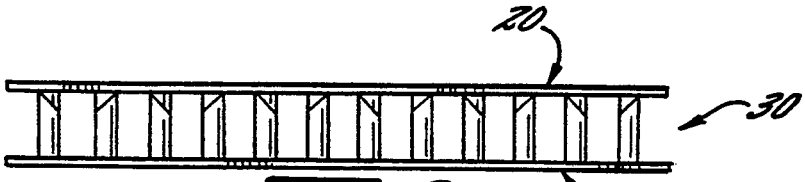
FIG. 3 is a front view of a truss plate couplet.

FIGS. 2 through 5 show a cooperating pair 30, or couplet, of truss plates 20, which is formed by positioning two truss plates so that their respective backing members 22 are disposed in parallel overlying relationship, with the impaling members 24 of each truss plate 20 extending toward the backing member 22 of the other truss plate. In such an arrangement, the positional relationship of the impaling members restricts the movement of truss plates comprising the pair relative to one another in a plane parallel to that of the respective backing members (FIGS. 3 through 5). In particular, impaling members 24 of slightly arcuate cross-section, such as those that have been formed by striking out a portion of a backing member 22, are effective in restricting lateral movement (i.e., movement. in a direction perpendicular to the longitudinal axes of apertures 26), as the arcuate portions of contacting impaling members 24 tend to nest (FIG. 5). The truss plates 20 comprising the cooperating pair 30 can be separated by lifting the backing member of one truss plate away from the backing member of the other truss plate, as such separatory movement in this direction is virtually unrestricted.

FIG. 7 shows a cross-sectional view of a truss plate couplet 30′ formed from a pair of truss plates 20′ having "staggered" impaling members 24′. As for the embodiment illustrated in FIGS. 1 through 5, some of the impaling members 24′ of a truss plate 20′ can nest with impaling members from the opposite truss plate, thereby constraining the truss plates from relative lateral movement.

Figure 8:
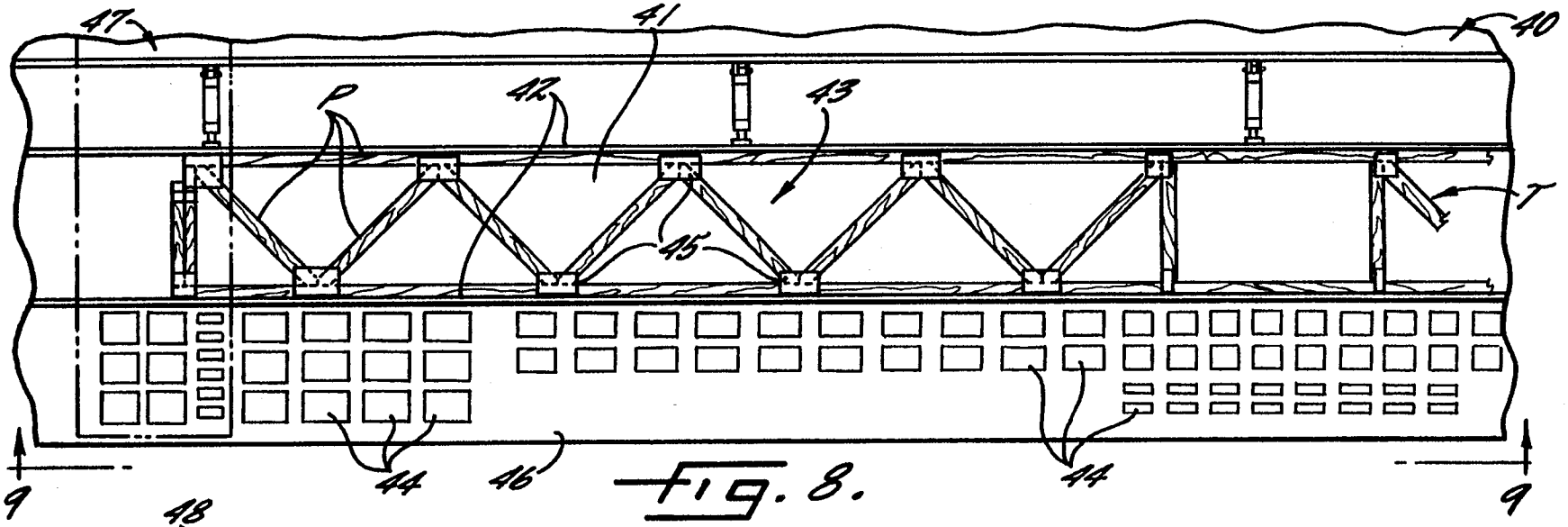
FIG. 8 is a plan view of an exemplary truss table with truss plate couplets stacked on the edge portion thereof.
Figure 9:
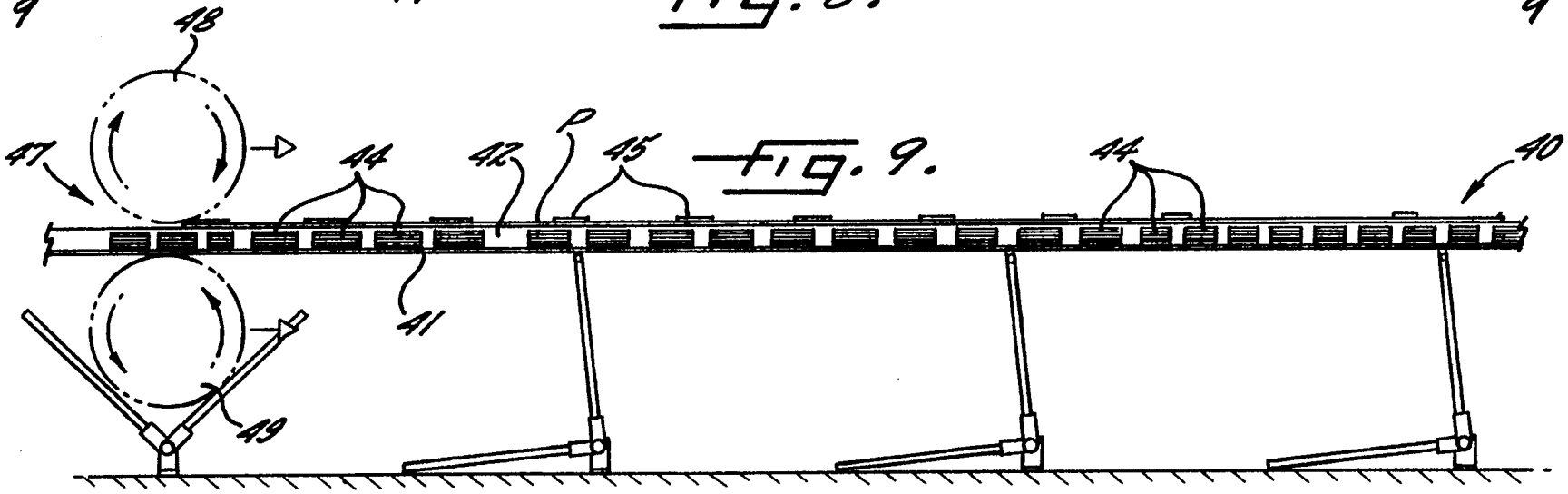
FIG. 9 is a front view of the truss table of FIG. 8.

The utility and desirability of forming individual truss plates into cooperating pairs, such as those illustrated in FIGS. 2 through 5 and 7, can be understood by referring to FIGS. 8 and 9, which illustrate a truss table 40 upon which an exemplary floor truss T is being constructed. The truss table 40 includes a generally horizontal support surface 41 and pair of upright rails 42 fixed thereto. The support surface 41 and the rails 42 define a cavity 43 within which the floor truss T is constructed.

During truss construction, initially planks P are arranged in a predetermined configuration exemplified by the triangulated web shown in FIG. 8. Truss plates, schematically illustrated at 45, are positioned at the joints formed by adjacent planks P and secured temporarily therein with a mallet or hammer. Once all of the truss plates 45 required for the truss T are in place, a pressure roller unit 47, which comprises a top roller 48 and a lower roller 49, is activated and directed to travel the length of the truss table 40 (FIG. 9). The top roller 48 and the lower roller 49 are positioned to sandwich the support surface 41, the rails 42, and the planks P. As the roller unit 47 travels along the length of the truss table 40, the rollers 48 and 49 press the truss plates 45 into the planks P so that their impaling members fully penetrate the planks P and so that the backing members of the truss plates 45 contact the plank upper surfaces, thereby permanently securing the joints between adjacent planks. The roller unit 47 typically extends the full width of the table 40; accordingly, any article resting on the support surface 41 of the table 40 that is taller than the lowest portion of the top roller 48 (which is approximately the height of the planks P) will be struck thereby during roller travel and thus will be disturbed. The width and proximity of the roller unit 47 to the table 40 cause a work area 46 at the edge portion of the truss table 40 to be quite short (generally between about 1 to 5 inches in height); accordingly, it is important to arrange truss plates in the work area 46 compactly in order to be able to store as many truss plates as possible. Commonly, truss plates are formed into couplets (schematically illustrated in FIGS. 8 and 9 at 44), which are stacked in the work area 46 to the height of the rail 42; in stacked couplet form, the truss plates can be compactly stored on the work area 46 until they are incorporated into a truss.

Figure 10:
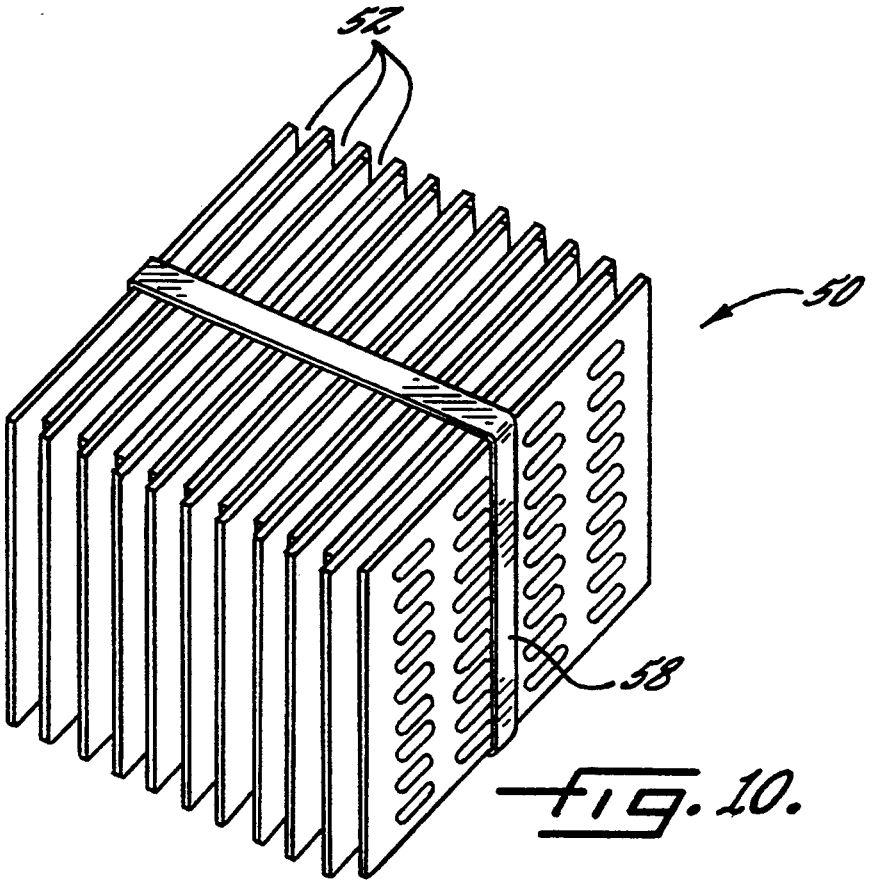
FIG. 10 is a front view of a truss plate bundle formed of couplets.
Figure 11:
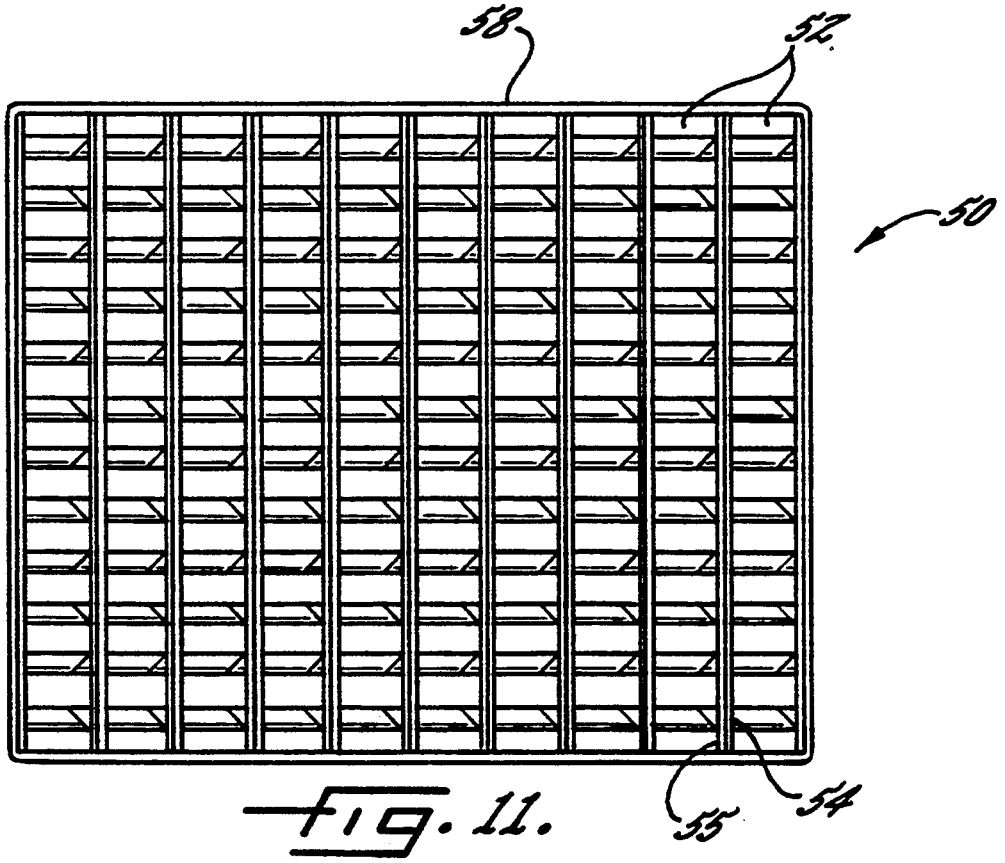
FIG. 11 is a perspective view of a truss plate bundle formed of couplets.

FIGS. 10 and 11 show a truss plate bundle 50, which comprises a plurality of cooperating truss plate pairs 52 bound as a unit by a strap 58. Providing truss plates in a bundle 50 facilitates handling thereof by providing them in a unit comprising cooperating parts. Providing cooperating pairs as a bundle significantly decreases the time required to produce a stack of cooperating pairs in the work area 46 of the table 40 shown in FIG. 8 prior to truss construction. The cooperating pairs 52 are arranged in the bundle so that the backing member (exemplified at 54) of one of the truss plates comprising each pair 52 is in contacting parallel relationship with a backing member (exemplified at 55) of an adjacent cooperating pair. It is preferred that the bundle 50 include a sufficient number of cooperating pairs 52 that the ratio between the overall length of the bundle 50 (measured parallel to a line normal to the backing members of the plates comprising the bundle) and its depth (representing the smaller of the length and width dimensions of the backing member 54) is between about 0.75 to 1 and 3 to 1, as this configuration increases the stability of stacked bundles. For example, a bundle of 4 inch by 3 inch truss plates having impaling members approximately 0.25 inches long typically includes 10 cooperating pairs (20 truss plates), which when bundled measure approximately 4 inches in length; this results in a length to depth ratio of approximately 1.33.

The strap 58 encircles the cooperating pairs 52 lengthwise (FIG. 10) and thereby binds them into a conveniently handled unit. Those skilled in this art will appreciate that, although the illustrated strap 58 is preferred, any connecting means cooperating with the truss plate pairs for effecting unitization thereof with backing members of adjacent cooperating pairs in parallel contacting relationship is suitable for use with the invention. An exemplary alternative connecting means is a wire extending through a specified aperture of each truss plate and crimped at each end to prevent the pairs from separating. The strap 58 or alternative connecting means should be configured so that the backing member perimeters of truss plates within the bundle 50 are substantially aligned. It is intended that bundles with substantially aligned backing members include those in which the backing member edges are slightly offset by approximately the thickness of an impaling member; this offset is caused by the mating of truss plates that each have a plane of mirror symmetry about in the length and width dimensions.

Figure 12:
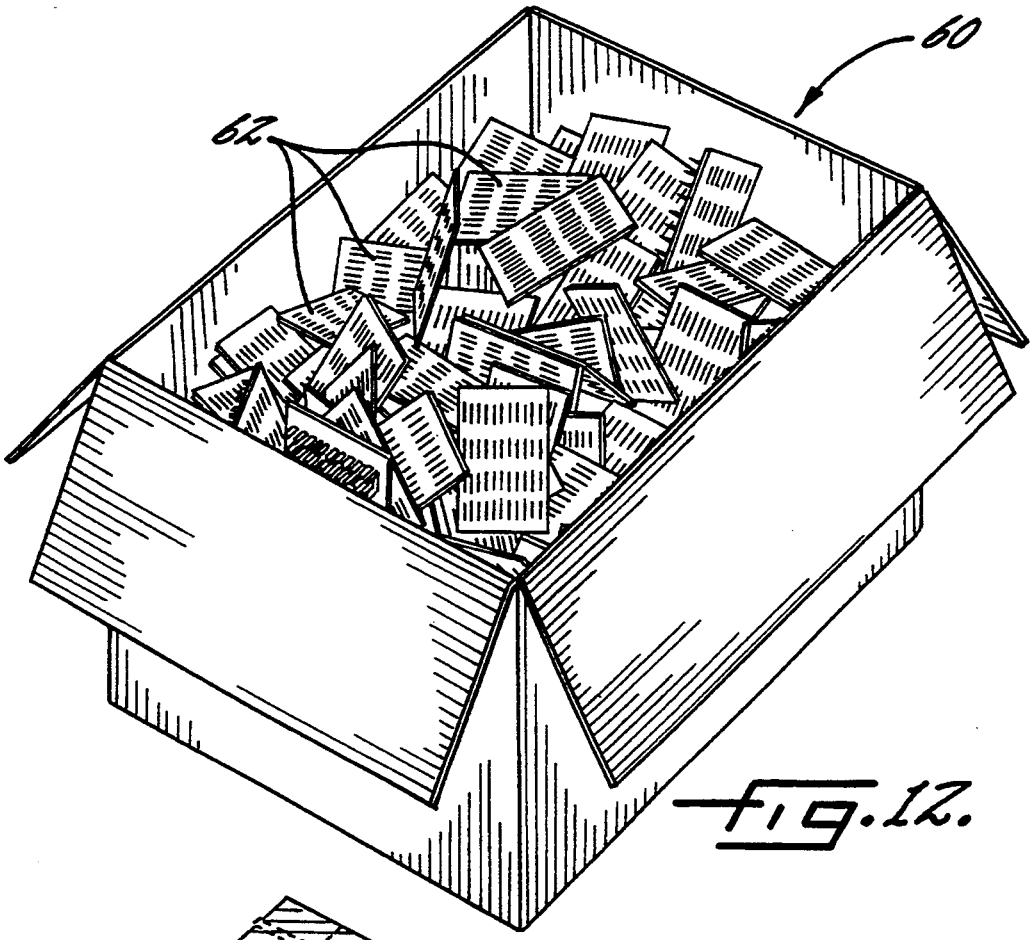
FIG. 12 is a perspective view of a typical carton used to ship randomly packed truss plates.
Figure 13:
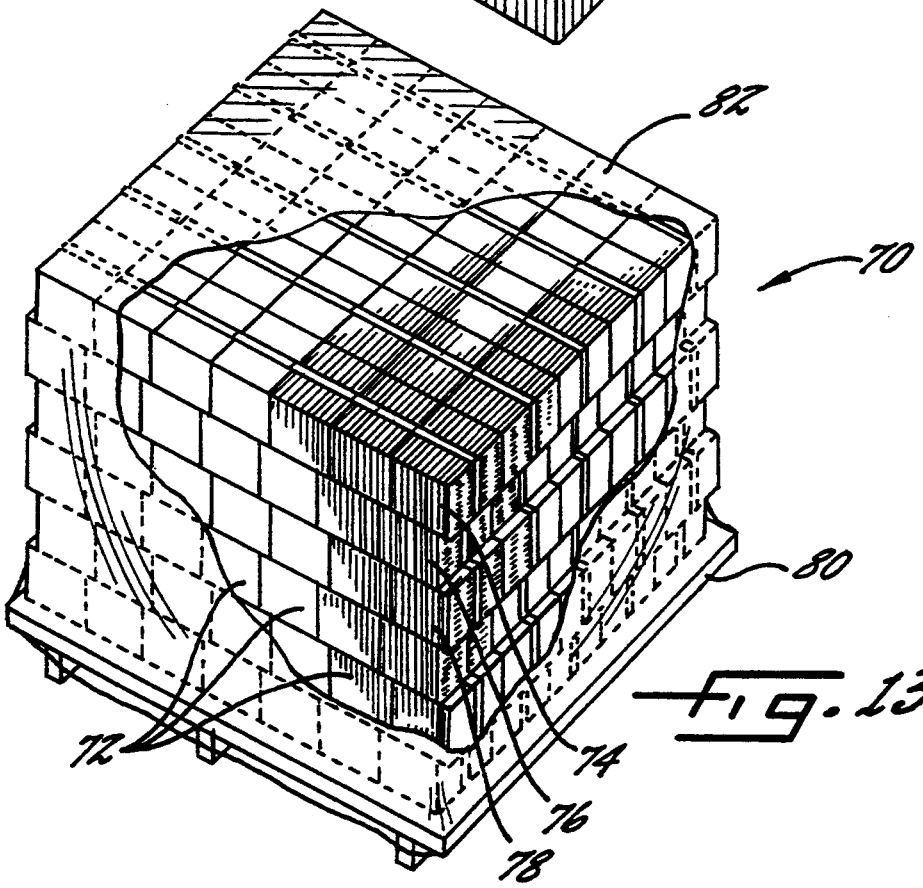
FIG. 13 is a partial cutaway perspective view of a package containing a stack of truss plate bundles bound in a shrinkable polymeric film on an underlying pallet.
Figure 14:
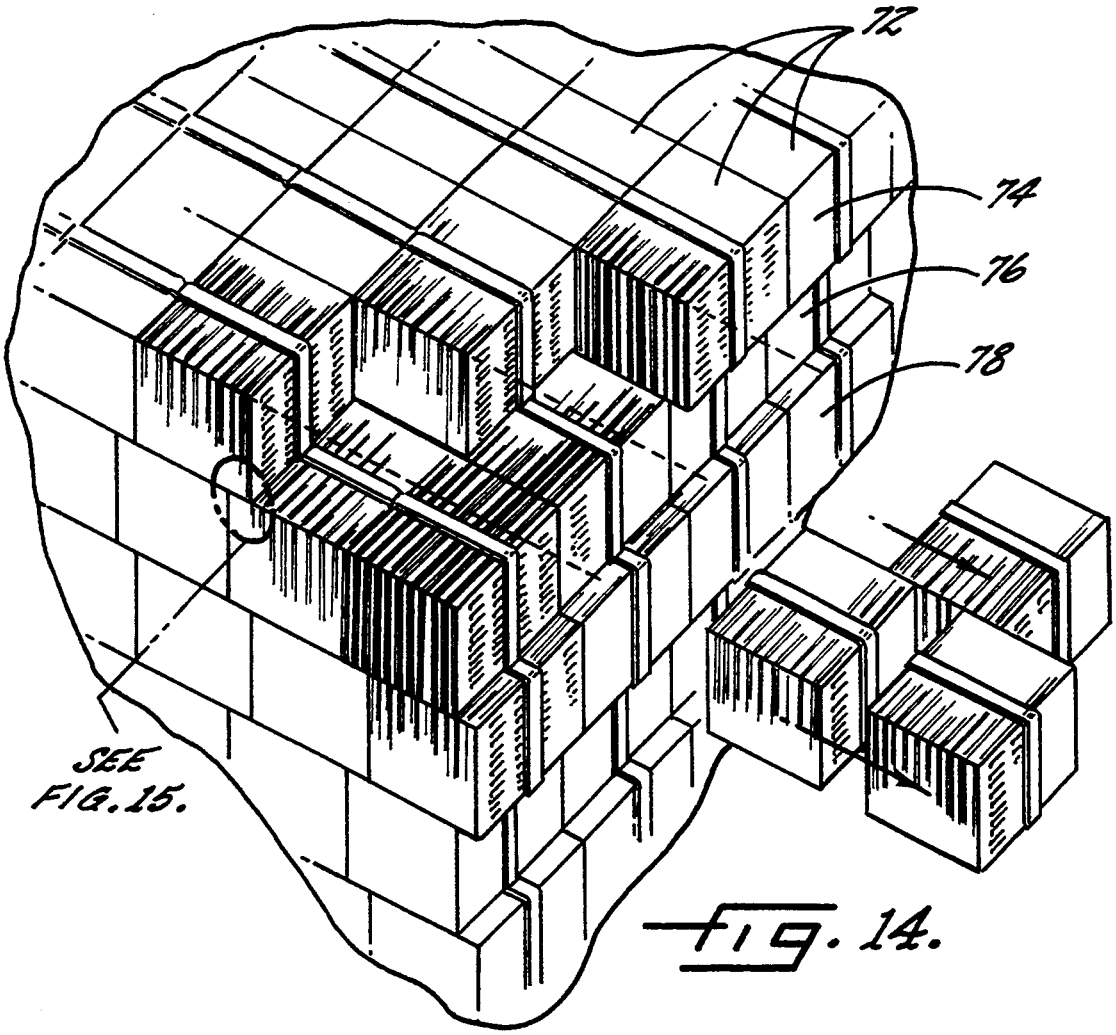
FIG. 14 is a fragmentary perspective view of a self-supporting stack of truss plate bundles without its enclosing wrapper.
Figure 15:
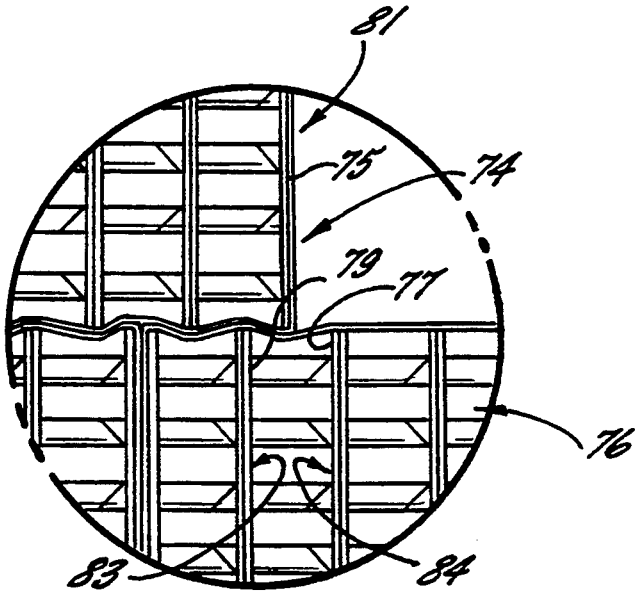
FIG. 15 is an enlarged view of a stack of truss plate bundles showing an offset stacking arrangement.

Forming truss plates into bundles such as those shown in FIGS. 10 and 11 not only facilitates handling of the plates, but also facilitates their packaging. FIG. 12 schematically illustrates the random manner in which truss plates are typically packed within a box 60; because the plates 62 are haphazardly and randomly distributed in the box, they are retained therein until use. FIGS. 13 and 14 show how a plurality of truss plate bundles of the present invention can be formed into a stack 70 that rests upon an underlying pallet 80. The stack 70 is then enclosed by a polymeric film wrapper 82 (shown in partial cutaway view in FIG. 13) that is attached to the pallet 80, although those skilled in this art will appreciate that other enclosing means, such as a cardboard carton, could be used in lieu of the wrapper 82. The stack 70 comprises a plurality of bundles 72 arranged in a plurality of vertical layers 74, 76, 78 (FIG. 14). The bundles 72 are oriented so that all of the truss plate backing members contained therein extend in an upright plane. The bundles 72 of each bundle layer 74, 76, 78 are illustratively and preferably arranged to be offset to the bundles of an adjacent layer, and should be so offset so that the backing member (shown at 75 in FIG. 15) of the endmost truss plate of a bundle in one layer 74 resides between planes defined by the backing members (shown by 77 and 79) of truss plates of bundles in an adjacent layer 76. In this arrangement, the lower edges of at least some of the truss plates of an adjacent upper layer can, due their own weight and the weight of layers above them, be forced into the space between the upper edges of the backing members of the truss plates comprising the adjacent lower layer; simultaneously, the upper edges of two plate backing members of the lower layer are forced between the backing members of the truss plates of the adjacent upper layer. The interpositioning of the backing members resists movement of the bundles relative to one another, particularly in a direction normal to that of the planes defined by truss plate backing members, and thereby provides the stack 70 with significant stability against toppling. The bundles of layer 78 are then positioned directly below the bundles of layer 74 so that the same positional relationship is retained between adjacent layers 76, 78. Preferably, the bundles of adjacent layers 74, 76 are offset (FIGS. 14 and 15) so that the backing member 75 of each endmost truss plate 81 of bundles in one layer 74 resides between the backing members 77, 79 of the truss plates 83, 84 that are third and fourth from the end of the bundle in an adjacent layer 76; i.e., the endmost backing member of the adjacent layer resides between the planes defined by the backing members of the couplet adjacent the endmost couplet of that bundle. However, the bundles of one layer may simply contact the bundles of an adjacent layer (i.e., the bundle layers are not offset) and still resist collapsing.

The stack 70 is sufficiently stable that it can be entirely self-supporting, particularly when the bundles 72 are oriented so that their length and width dimension exceed their depth dimension. As a result, when the wrapper 82 is removed as illustrated in FIG. 13, the stack 70 does not collapse or topple, but instead remains standing.

The ability of the stack 70 to remain erect when free-standing provides tremendous advantages in the shipping, storage, and handling of truss plates. First, because the stack 70 does not collapse, it can be formed on an underlying pallet by the manufacturer, enclosed within a wrapper or other enclosing means, and shipped in this form to a distant location. Once there, the wrapper can be removed and discarded without disturbing the stack 70. Also, when the stack 70 is maintained on a pallet, it can be moved about the facility with a forklift or other pallet-transporting means. In contrast, truss plates packed randomly as illustrated in FIG. 12 are not shipped in enclosures having an underlying pallet. The haphazard distribution of truss plates precludes the use of a polymeric film wrapper like that illustrated at 82 in FIG. 13; thus some other enclosing means, such as a cardboard carton, would be required. Generally, pallet cartons are sufficiently large that items contained therein cannot be accessed easily without removing the carton walls. Such removal would cause truss plates randomly packed in a carton to spill from the carton, thereby creating unkempt and even hazardous conditions. As a result, randomly packed truss plates are packaged in much smaller boxes sized to permit easy removal of the truss plates therefrom. The material comprising the enclosing container to must be disposed of somehow; however, the waste created by a single sheet of polymer film or a single carton attached to a pallet is considerably less than that created by the numerous smaller cartons required to ship a similar number of truss plates. Thus the capability of packaging truss plates in a large pallet configuration, which ability is a result of the present invention, decreases the truss builders' waste disposal costs significantly.

Second, by forming the truss plates into bundles that are then stacked as shown in FIGS. 13 and 14, packaging density is increased substantially. For example, a box measuring 21 inches by 13½ inches by 16 inches holds no more than 70 pounds of randomly packed truss plates. Approximately 35 boxes of this size occupy the same volume as that of a single pallet and wrapper measuring 45 inches by 48 inches by 78 inches. The 35 randomly packed boxes contain approximately 2500 pounds of truss plates, while the same volume of stacked truss plates weighs between 6000–7000 pounds. As a result, the storage space requirements for a stack of truss plates are considerably less than those for randomly packed truss plates.

Third, the stack 70 can be slowly disassembled by removing one or more truss plate bundles 72 without the entire stack 70 collapsing. This saves time in the accessing and handling of truss plates, as the line worker need not take the time to open a box, place it in a convenient location, and reach in and gather truss plates; instead, a bundle can be removed from the stack as needed.

Finally, bundles 72 that include aligned couplets of truss plates comprise the stack 70, so the formation of truss plate couplets along the working area of a truss table such as that shown in FIGS. 8 and 9 is rapid and simple. In contrast, truss plates packaged randomly in boxes must be removed one at a time and mated into couplet form.

The foregoing embodiments are illustrative of the present invention, and are not to be construed as limiting thereof. The invention is defined by the following claims, with equivalents of the claims to be included therein.

That which is claimed is:

1. A bundle of truss plates, comprising:

a plurality of truss plates, wherein each truss plate has a generally planar backing member and a plurality of impaling members extending outwardly from one side thereof, said truss plates being arranged in a plurality of cooperating pairs, wherein said backing members of each of said pair are disposed in a parallel overlying relationship, with the impaling members of each truss plate extending toward the backing member of the other truss plate of the pair; and connecting means cooperating with said plurality of pairs of truss plates for effecting unitization thereof so that the backing member of one of said truss plates of each pair is in contacting parallel relationship with a backing member of another of said plurality of cooperating pairs.

2. The bundle of claim 1, wherein said connecting means is configured so that the perimeters of each of said truss plate backing members are substantially aligned.

3. The bundle of claim 2, wherein said connecting means comprises a strap encircling said plurality of truss plate pairs.

4. The bundle of claim 2, wherein each of said backing members is substantially rectangular.

5. The bundle of claim 1, wherein each of said impaling members is struck out of said backing member.

6. The bundle of claim 4, wherein each of said rectangular backing members has a length to width ratio of between about 1 to 1 and 4 to 1.

7. The bundle of claim 6, wherein said plurality of truss plates comprises at least 10 truss plates, and wherein said backing members and said impaling members of said truss plates are configured so that the length to depth ratio of said bundle is between about 0.75 to 1 and 3 to 1.

8. A stack of truss plate bundles, each of said truss plate bundles comprising:

a plurality of truss plates, wherein each truss plate has a generally planar backing member and a plurality of impaling members extending outwardly from one side thereof, said truss plates being arranged in a plurality of cooperating pairs, wherein said backing members of each of said pair are disposed in a parallel overlying relationship, with the impaling members of each truss plate extending toward the backing member of the other truss plate of the pair; and connecting means cooperating with said plurality of pairs of truss plates for effecting unitization thereof so that the backing member of one of said truss plates of each pair is in contacting parallel relationship with a backing member of another of said plurality of cooperating pairs;

wherein a plurality of said truss plate bundles is arranged in a plurality of layers, with the bundles of each respective layer contacting the bundles of an adjacent layer, and wherein all of said truss plate backing members extend in an upright plane.

9. The stack of claim 8, wherein said connecting means is configured so that the perimeters of each of said truss plate backing members are substantially aligned.

10. The stack of claim 9, wherein said connecting means comprises a strap encircling said plurality of truss plate pairs.

11. The stack of claim 10, wherein each of said backing members is substantially rectangular.

12. The stack of claim 9, wherein each of said rectangular backing members has a length to width ratio of between about 1 to 1 and 4 to 1.

13. The stack of claim 9, wherein said plurality of truss plates comprises at least 10 truss plates, and wherein said backing members and said impaling members of said truss plates are configured so that the length to depth ratio of said bundles is between about 0.75 to 1 and 3 to 1.

14. The stack of claim 9, wherein each of said bundles is oriented so that the length dimension of each backing member resides in a generally horizontal plane.

15. The stack of claim 9, wherein the bundles of each layer are offset from the bundles of an adjacent layer.

16. The stack of claim 15, wherein the bundles of each layer are offset from the bundles of an adjacent layer so that the backing layer of the end most truss plate of bundles in a first layer resides between planes defined by the backing members of truss plates of the bundles in an adjacent second layer.

17. The stack of claim 16, wherein the planes defined by the backing members of truss plates of the bundles in said second layer are defined by the backing members of the truss plates comprising the cooperating pair adjacent the endmost cooperating pair of that bundle.

18. A package of truss plates, comprising:

a stack of truss plate bundles, each of said bundles comprising:

a plurality of truss plates, wherein each truss plate has a generally planar backing member and a plurality of impaling members extending outwardly from one side thereof, said truss plates being arranged in a plurality of cooperating pairs, wherein said backing members of each of said pair are disposed in a parallel overlying relationship, with the impaling members of each truss plate extending toward the backing member of the other truss plate of the pair; and connecting means cooperating with said plurality of pairs of truss plates for effecting unitization thereof so that the backing member of one of said truss plates of each pair is in contacting parallel relationship with a backing member of another of said plurality of cooperating pairs;

wherein a plurality of said truss plate bundles is arranged in a plurality of layers, with the bundles of each respective layer contacting the bundles of an adjacent layer, and wherein all of said truss plate backing members extend in an upright plane; and pallet means underlying said stack for supporting said stack for shipping and storage thereof.

19. The truss plate package of claim 18, further comprising means connected with said pallet means for enclosing said stack.

20. The truss plate package of claim 19, wherein said connecting means is configured so that the perimeters of each of said truss plate backing members are substantially aligned.

21. The truss plate package of claim 19, wherein said connecting means comprises a strap encircling said plurality of truss plate pairs.

22. The truss plate package of claim 21, wherein each of said backing members is substantially rectangular.

23. The truss plate package of claim 22, wherein each of said rectangular backing members has a length to width ratio of between about 1 to 1 and 4 to 1.

24. The truss plate package of claim 23, wherein said plurality of truss plates comprises at least 10 truss plates, and wherein said backing members and said impaling members of said truss plates are configured so that the length to depth ratio of said bundles is between about 0.75 to 1 and 3 to 1.

25. The truss plate package of claim 20, wherein each of said bundle layers is offset from an adjacent bundle layer.

26. The truss plate package of claim 25, wherein the bundles of each layer are offset from the bundles of an adjacent layer so that the backing layer of the end most truss plate of bundles in a first layer resides between planes defined by the backing members of truss plates of the bundles in an adjacent second layer.

27. The truss plate package of claim 26, wherein the planes defined by the backing members of truss plates of the bundles in said second adjacent layer are defined by the backing members of the truss plates comprising the cooperating pair adjacent the endmost cooperating pair of that bundle.

28. A method of packaging truss plates, comprising the steps of:

forming a plurality of truss plate bundles, wherein each of said truss plate bundles comprises a plurality of truss plates, wherein each truss plate has a generally planar backing member and a plurality of impaling members extending outwardly from one side thereof, said truss plates being arranged in a plurality of cooperating pairs, wherein said backing members of each of said pair are disposed in a parallel overlying relationship, with the impaling members of each truss plate extending toward the backing member of the other truss plate of the pair; and each of said bundles further comprises connecting means cooperating with said plurality of pairs of truss plates for effecting unitization thereof so that the backing member of one of said truss plates of each pair is in contacting parallel relationship with a backing member of another of said plurality of cooperating pairs; and stacking said plurality of said truss plate bundles in a plurality of layers, with the bundles of each respective layer contacting to the bundles of an adjacent layer, and with all of said truss plate backing members extending in an upright plane.

29. The method defined in claim 28, wherein said stacking step comprises stacking said bundles on an underlying pallet.

30. The method defined in claim 28, further comprising the step of enclosing said stack with a wrapper connected to the underlying pallet.

31. The method defined in claim 28, wherein the bundles of each layer are offset from the bundles of an adjacent layer.

* * * * *

UNITED STATES PATENT AND TRADEMARK OFFICE

CERTIFICATE OF CORRECTION

PATENT NO. : 5,392,908

DATED : February 28, 1995

INVENTOR(S) : William H. Black, Jr.

It is certified that error appears in the above-indentified patent and that said Letters Patent is hereby corrected as shown below:

Column 4, line 61, omit the period preceeding the word "in".

Signed and Sealed this

Fifth Day of September, 1995

*Attest:*

*Attesting Officer*

BRUCE LEHMAN

*Commissioner of Patents and Trademarks*